United States Patent [19]

Giger et al.

[11] 4,083,179

[45] Apr. 11, 1978

[54] REGULATOR KEY FOR WATCH MOVEMENTS

[75] Inventors: Urs Giger, Solothurn; Edwin Jakob, Grenchen, both of Switzerland

[73] Assignee: ETA A.G. Ebauches Fabrik, Switzerland

[21] Appl. No.: 735,731

[22] Filed: Oct. 26, 1976

[30] Foreign Application Priority Data

Nov. 4, 1975 Switzerland ..... 14229/75

[51] Int. Cl.[2] ..... G04B 17/14

[52] U.S. Cl. ..... 58/109

[58] Field of Search ..... 58/109

[56] References Cited

U.S. PATENT DOCUMENTS

| | | | |
|---|---|---|---|
| 229,215 | 6/1880 | Wheeler | 58/109 |
| 812,234 | 2/1906 | Roost | 58/109 |
| 3,306,026 | 2/1967 | Kocher | 58/109 |
| 3,564,840 | 2/1971 | Meitinger | 58/109 |
| 3,630,016 | 12/1971 | Fujihiri | 58/109 |
| 3,638,419 | 2/1972 | Diersbock | 58/109 |
| 3,745,763 | 7/1973 | Zaugg | 58/109 |

FOREIGN PATENT DOCUMENTS

| | | | |
|---|---|---|---|
| 562,490 | 10/1932 | Germany | 58/109 |
| 292,133 | 10/1953 | Switzerland | 58/109 |

OTHER PUBLICATIONS

Horological Dictionary of Ebauches S.A., pp. 6, 113.

*Primary Examiner*—Stanley J. Witkowski
*Attorney, Agent, or Firm*—Stevens, Davis, Miller & Mosher

[57] ABSTRACT

A one-piece regulator key for watch movements includes two spaced apart prongs projecting from and integral with a common support, each prong has an inward plane surface facing and substantially parallel to a like inward plane surface on the other prong and is provided at its free end with an inwardly projecting protuberance for decreasing the spacing between the prongs at their free ends.

6 Claims, 2 Drawing Figures

REGULATOR KEY FOR WATCH MOVEMENTS

This invention relates to a one-piece, two-pronged regulator key for watch movements.

One-piece regulator keys having two parallel prongs are already known, particularly from Swiss Pat. Nos. 116,621 and 170,802. These keys are secured to the short arm of the regulator, e.g., by riveting the head of the key in a hole in the arm, and the two prongs extend parallel to one another and to the axis of rotation of the regulator so as to embrace outermost turn of the balance spring and enable its active length to be regulated. Keys of this kind can be manufactured from cylindrical metal bars by profile-turning, for their machining requires only turning and milling operations. In particular, the slot separating the two prongs of the key can be formed by means of a disk-cutter, and this operation may be incorporated in the cycle of the automatic lathe. As a result, however, the slot thus formed will necessarily have the same width throughout its length.

Furthermore, conventional regulator keys intended to be secured to the short arm of the regulator opposite a cylindrical pin are known to have, at the end of the key, a rim which faces the end of the pin and narrows the gap between key and pin within which the balance spring oscillates during normal operation of the movement, thus preventing the spring from being jolted out of the gap in the event of an axial shock.

One-piece, two-pronged regulator keys represent a more favorable solution, from the point of view of the machining and assembly operations, than conventional keys associated with a separate pin. Until now, however, their use has been restricted because the fact that the slot is not narrowed at the end has meant that the balance spring is liable to become disengaged in the event of an axial shock. Moreover, it may happen that the second turn of the balance spring becomes caught in the slot. No means has hitherto been known for enabling the efficient manufacture of one-piece, two-pronged regulator keys having engaging rims at the ends of the prongs, analogous to those of conventional keys.

It is an object of this invention to provide a regulator key which remedies these shortcomings.

To this end, the one-piece regulator key according to the present invention comprises two spaced prongs and two facing protuberances projecting laterally from the respective tips of the prongs for decreasing the spacing between the prongs at the tips thereof.

Figure 1:
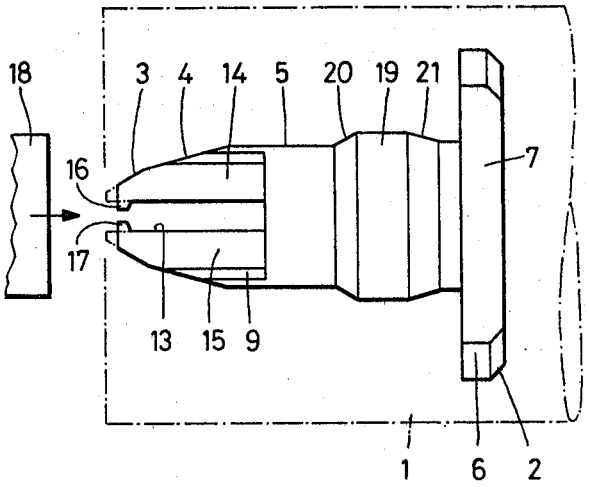
Figure 2:
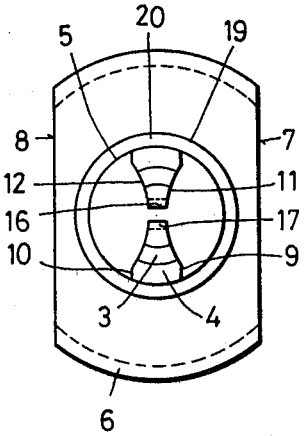

A preferred embodiment of the invention will now be described in detail with reference to the accompanying drawing, in which:

FIG. 1 is an elevation of this embodiment with a stamping tool facing the ends of the prongs, and FIG. 2 is an end-on view of the regulator key of FIG. 1.

Shown in dot-dash lines in FIG. 1 is the end of a cylindrical metal bar 1 to be machined, which is engaged in the chuck of an automatic lathe and projects in front of the tools intended to machine a part designated as a whole by reference numeral 2. The sequence of machining operations to be carried out in order to give part 2 its final shape is as follows; first, starting from the left-hand edge of bar 1, as viewed in FIG. 1, successive frustoconical surfaces 3 and 4, coaxial with bar 1, and a cylindrical surface 5 are formed by turning. Then, starting from the right-hand end of surface 5, bar 1 is again turned along a frustoconical surface up to a diameter which will correspond to that of a head 6. Bar 1 is then stopped and locked and, by means of an assembly comprising four coaxial disk-cutters positioned vertically as viewed in FIG. 2, four flats are formed in bar 1, viz., two parallel flats 7 and 8 situated at the right-hand end of part 2, as viewed in FIG. 1, and two flats 9 and 10 which are parallel to flats 7 and 8 but which are situated in the frustoconical section bounded by surfaces 3 and 4 and in part of the cylindrical portion bounded by surface 5.

Next, by means of a milling cutter, the axis of which is parallel to that of bar 1, two concave surfaces 11 and 12 are successively formed in that bar 1 is rotated by 180° about its axis once surface 11 has been completely machined. These two operations will be carried out using a straight-shank plain cutter, the diameter of which is equal to that of concave surfaces 11 and 12—in a particular case, for example, 0.6 mm.

After the straight-shank plain cutter has been removed, and while bar 1 is still locked, a disk-cutter is put in place; the axis of rotation of this cutter is vertical as viewed in FIG. 2, and the cutter is situated on a level with the axis of bar 1 so as to divide the left-hand portion of part 2, as viewed in FIG. 1, by means of a slot 13 having parallel sides, into two prongs 14 and 15. As may be seen in FIG. 2, the profiles of the prongs have the look of a triangle with curved sides; and because of frustoconical surfaces 4 and 3, the cross-section of the profile gradually decreases from the base of each prong 14, 15 toward the tip thereof.

It is at this stage of the machining process that an operation takes place for forming two inner protuberances 16 and 17 which narrow slot 13 at the end thereof. This operation is carried out by means of a stamping tool 18 which may, for example, take the form of a flat disk. Tool 18 is moved in line with the axis of bar 1 so as to flatten the tips of prongs 14 and 15. Because of the particular shape of the profile of these prongs, the material compressed by the impact of tool 18 is forced inward, forming the two protuberances 16 and 17. Thus, for example, where the width of slot 13 is on the order of 0.1 mm., the width of the free space between protuberances 16 and 17 will be 0.03 mm.

It follows from the foregoing that slot 13 is bounded by two inside faces which are plane and parallel, so that each of the protuberances 16 and 17 likewise exhibits a substantially rectangular profile and projects from one of these plane faces. The regulator key will be mounted on the short arm of a regulator and so positioned that the side faces of slot 13 extend obliquely with respect to the portion of the balance spring engaged in that slot. Hence the active length is alternately limited by contact of the outer face of the spring blade with an edge of one of the prongs of the key and by contact of the inner face of the spring blade with the opposite edge of the other prong of the key. Thus the apparent width of slot 13 is less than 0.1 mm. It will, for example, be reduced to 0.05 mm, and protuberances 16 and 17 will totally prevent any untimely disengagement of the balance spring, whatever may be its position. For the same reason, they will also prevent any part of the second turn from becoming caught in the slot, so that the intended object is indeed achieved owing to the presence of protuberances 16 and 17.

After protuberances 16 and 17 have been formed turning of the opposite end of part 2 is completed. As may be seen in the drawing, there is formed between head 6 and cylindrical portion 5 an annular collar 19 bounded on the side toward prongs 14 and 15 and on the side toward head 6 by frustoconical surfaces 20 and 21, respectively, surface 21 having an inclination on the order of 15°, for example. The left-hand face of head 6, as viewed in FIG. 1, takes the form of a flat shoulder extending out to a diameter slightly greater than that of cylindrical surface 5; and between the right-hand side of surface 21 and the left-hand face of head 6, the key exhibits another cylindrical portion turned to the same diameter as cylindrical surface 5.

Thereafter, all that remains to be done is to machine the forward bevel of head 6 and to detach the finished part 2 from bar 1. As may be seen, the stamping operation described can easily be incorporated into the cycle of operations of the automatic lathe, so that all the manufacturing operations are carried out automatically.

As thus produced, the regulator key described may be mounted on the short arm of the regulator (not shown) by providing in that arm a slot having parallel sides in which there are two facing hollows. The key may be mounted on the short arm of the regulator by engagement between these hollows. When collar 19 enters in between the two hollows, the slot opens slightly, then closes again on conical portion 21. The key is then held axially, conical portion 21 resting on the lower edges of the hollows in the short arm of the regulator, causing head 6 to lie flat against the upper surface of that arm. The key can than be seized by flats 7 and 8 of head 6 and correctly positioned.

In another embodiment, stamping tool 18 might be replaced by a stamping tool in the form of a sleeve having a cylindrical side surface matching the diameter of portion 5. This sleeve would have a flat bottom analogous to the front face of disk 18. As a variation, however, the front face of the stamping tool might equally well have a different shape, e.g., with a conical projection or a concave recess.

What is claimed is:

1. A one-piece regulator key for watch movements comprising two spaced apart prongs projecting from and formed integral with a common support, each of said prongs having an inward plane surface facing a corresponding inward plane surface of the other prong with said inward surface being substantially parallel to one another, each prong also having a free end with a tip at that free end, said tips containing respective inwardly facing protuberances projecting laterally and inwardly from said plane surfaces at said tips for decreasing the spacing between said plane surfaces at said tips, said prongs being adapted to hold a spring element in the spacing between said plane surfaces.

2. The regulator key of claim 1, wherein said common support contains a cylindrical portion from which the prongs project.

3. The regulator key of claim 1, wherein the prongs have cross-sections having the same shape, that shape resembling triangles with curved sides.

4. The regulator key of claim 1, wherein each of the prongs gradually decreases in cross-section toward the tip thereof.

5. The regulator key of claim 1, wherein said common support comprises a flat, overhanging head disposed at the end of said key remote from said free ends, the periphery of the head comprising two plane faces.

6. The regulator key of claim 5, wherein said common support further comprises a cylindrical portion from which the prongs project and an annular protrusion disposed between the cylindrical portion and the overhanging head, the face of the protrusion nearest the head being frustoconical in shape.

* * * * *